US007339536B2

(12) United States Patent
Hung et al.

(10) Patent No.: US 7,339,536 B2
(45) Date of Patent: Mar. 4, 2008

(54) MULTI-BAND ANTENNA

(75) Inventors: Chen-Ta Hung, Tu-Cheng (TW); Shu-Yean Wang, Tu-Cheng (TW); Hsien-Sheng Tseng, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/593,213

(22) Filed: Nov. 6, 2006

(65) Prior Publication Data

US 2007/0103370 A1 May 10, 2007

(30) Foreign Application Priority Data

Nov. 4, 2005 (TW) ..... 94138687 A

(51) Int. Cl.
*H01Q 1/24* (2006.01)
*H01Q 1/38* (2006.01)

(52) U.S. Cl. ..... 343/702; 343/700 MS

(58) Field of Classification Search ..... 343/702, 343/700 MS, 846
See application file for complete search history.

(56) References Cited

U.S. PATENT DOCUMENTS

| | | | | |
|---|---|---|---|---|
| 6,426,723 | B1 * | 7/2002 | Smith et al. | 343/700 MS |
| 6,897,810 | B2 * | 5/2005 | Dai et al. | 343/700 MS |
| 7,136,025 | B2 * | 11/2006 | Lin et al. | 343/700 |
| 7,212,161 | B2 * | 5/2007 | Chen et al. | 343/700 MS |
| 2004/0257283 | A1 * | 12/2004 | Asano et al. | 343/702 |
| 2005/0104788 | A1 * | 5/2005 | Hung et al. | 343/702 |
| 2005/0190108 | A1 * | 9/2005 | Lin et al. | 343/702 |
| 2006/0262016 | A1 * | 11/2006 | Hung et al. | 343/702 |
| 2007/0075902 | A1 * | 4/2007 | Tai et al. | 343/700 MS |

* cited by examiner

*Primary Examiner*—Trinh Vo Dinh
(74) *Attorney, Agent, or Firm*—Wei Te Chung

(57) ABSTRACT

A multi-band antenna (1) includes a first antenna (1*a*), a second antenna (1*b*) and a grounding element (2). The first antenna (1*a*) includes a radiating element (10), a connecting element (20) connecting the radiating element (10) and the grounding element (2) and a feeding line. The radiating element (10) includes a first radiating section (11) working at a lower frequency, a second radiating (12) section working at a higher frequency and a third radiating section (13).

20 Claims, 7 Drawing Sheets

MULTI-BAND ANTENNA

BACKGROUND OF THE INVENTION

1. Field of the Invention

The present invention relates generally to a multi-band antenna, and more particularly to a multi-band antenna used for wireless local area network.

2. Description of the Prior Art

As communication technology is increasingly improved, the weight, volume, cost, performance, and complexity of a communication system also become more important, so antennas that transmit and receive signals in a wireless communication system especially 'draw designers' attention. In a wireless local area network (WLAN), because the space for setting up an antenna is limited and the antenna should transmit a large amount of data, the antenna should be carefully designed. And for the requirement of small size, the antenna is needed to be able to transmit all signals of WLAN bands, 802.11b(2.4 GHz) and 802.11a(5.2 GHz).

Referring now to FIG. 1, a multi-band antenna 1' is shown and includes a radiating element 2', a grounding element 4', a feeding line 5' and a connecting element 3'. The radiating element 2' comprises a first radiating portion 2*a*' and a second radiating portion 2*b*'. The first radiating portion 2*a*' comprises a first radiating arm 20', a second radiating arm 21' and a third radiating arm 22'. The second radiating portion 2*b*' comprises the second radiating arm 2', the third radiating arm 22' and a forth radiating arm 23'. The first radiating arm 20', the second radiating arm 21', the third radiating arm 22', the grounding element 4', the connecting element 3' and the feeding line 5' compose of a first inverted-F antenna. The second radiating arm 21', the third radiating arm 22', the forth radiating arm 23', the grounding element 4', the connecting element 3' and the feeding line 5' compose of a second inverted-F antenna. The first inverted-F antenna is operated at a lower frequency, and the second inverted-F antenna is operated at a higher frequency. However, blind area unavoidably exists in the multi-band antenna 1' which influences performances of the multi-band antenna 1' in great extent.

Hence, an improved antenna is desired to overcome the above-mentioned shortcomings of the existing antennas.

BRIEF SUMMARY OF THE INVENTION

A primary object, therefore, of the present invention is to provide a multi-band antenna with simple structure, reduced size and wider bandwidth.

In order to implement the above object and overcomes the above-identified deficiencies in the prior art, the multi-band antenna comprises: a first antenna, a second antenna and a grounding element. The first antenna comprises a radiating element comprising a first radiating section working at a lower frequency, a second radiating section working at a higher frequency and a third radiating section, a connecting element, connecting the radiating element and the grounding element, and a feeder line.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
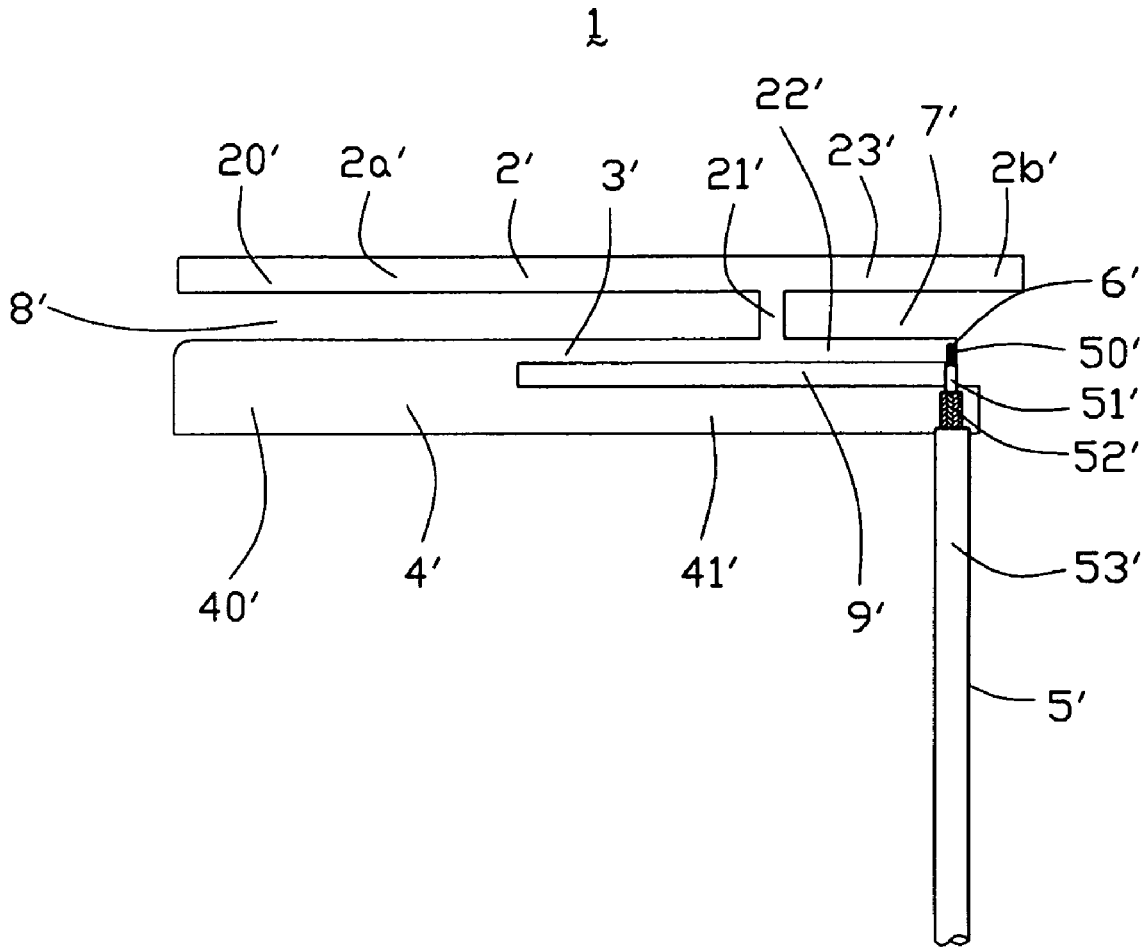
FIG. 1 (PRIOR ART)
FIG. 1 is a plan view illustrating a conventional multi-band antenna.
Figure 2:
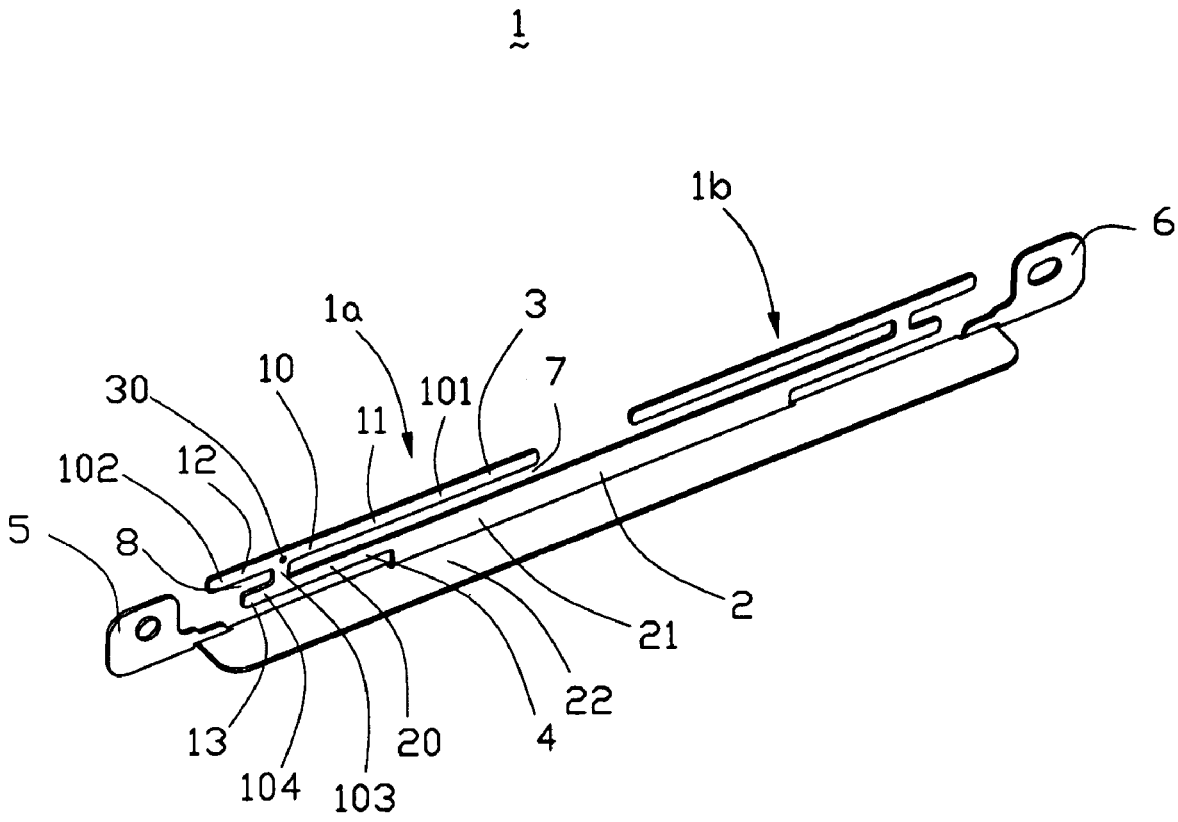
FIG. 2 is a perspective view of a multi-band antenna according to a preferred embodiment of the present invention.

Referring to FIG. 2, a multi-band antenna 1 according to the present invention is shown. The multi-band antenna 1 is made of a metal patch, and comprises symmetrically arranged first antenna 1*a* and second antenna 1*b*, and a common grounding element 2.

The first antenna 1*a* comprises a radiating element 10, the grounding element 2, a feeding line (not shown) and a connecting element 20 connecting the radiating element 10 and the grounding element 2.

The radiating element 10 comprises a first radiating section 11, a second radiating section 12 and a third radiating section 13. The first radiating section 11 comprises a first radiating arm 101, and the second radiating section 12 comprises a second radiating arm 102. The third radiating section 13 comprises a third radiating arm 103 and a fourth radiating arm 104. The first radiating arm 101 and the second radiating arm 102 locate in the same plane to form a first lengthwise metal arm 3. The third radiating arm 103 is perpendicular to the first radiating arm 101 and the second radiating arm 102 and extends from the joint of the first radiating arm 101 and the second radiating arm 102. The fourth radiating arm 104 is perpendicular to the third radiating arm 103 and extends along the direction parallel to the second radiating arm 102 from lower end of the third radiating arm 103. The fourth radiating arm 104 and the connecting element 20 constitute a second lengthwise metal arm 4. The grounding element 2 comprises a first grounding portion 21 and a second grounding portion 22 located in a horizontal plane perpendicular to that of the first grounding portion 21. The first grounding portion 21 wider than the connecting element 20 extends from the connecting element 20. The second grounding portion 22 extends vertically from the first grounding portion 21 and forms a metal patch. The first lengthwise metal arm 3 is parallel to the second lengthwise metal arm 4 and thus, forms a first notch 7 and a second notch 8 therebetween. The first notch 7 and the second notch 8 is vertically spaced by the third radiating arm 103. The first lengthwise metal arm 3, the third radiating arm 103 and the second longwise metal arm 4 constitute an inverted H shape frame.

The feeding line connects the radiating element 10 on the joint of the first radiating arm 101 and the second radiating arm 102. The first radiating section 11 works at a lower frequency. The second radiating section 12 works at a higher frequency cooperating with the third radiating section 13 increase its bandwith and gain. In alternative embodiments of the present invention, the location of joint of the feeding line and the radiating element 10 can be changeable to alter the impedance.

The second antenna 1*b* and the first antenna 1*a* are identical are oriented at opposite sides of the first grounding portion 21 to be mirror images of each other. Both of the first antenna 1*a* and the second antenna 1*b* are used as WLAN antennas to form a dual WLAN antenna.

A pair of mounting portions 5, 6 respectively extend from the opposite sides of the second grounding portion 22 of the grounding element 2 and are located in the same plane as that of the first grounding portion 21.

Figure 3:
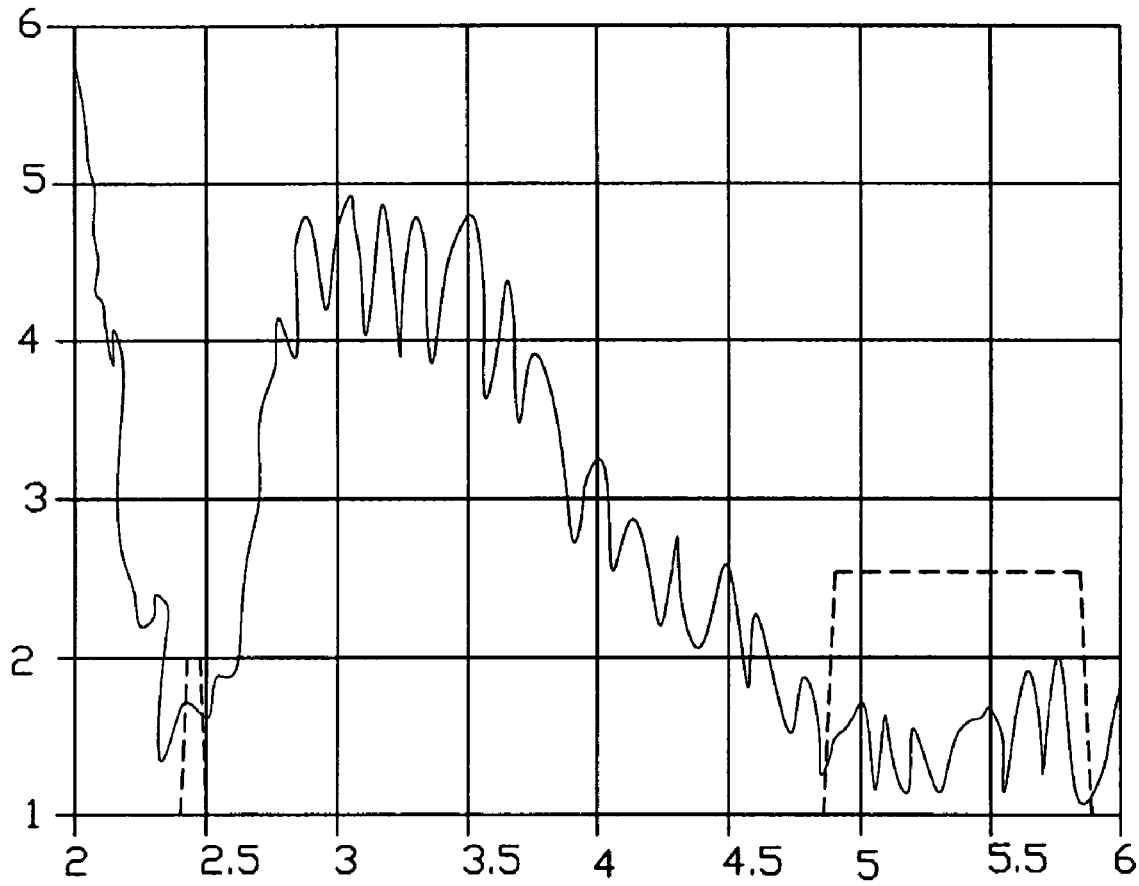
FIG. 3 is a test chart recording of Voltage Standing Wave Ratio (VSWR) of the multi-band antenna as a function of frequency.
Figure 4:
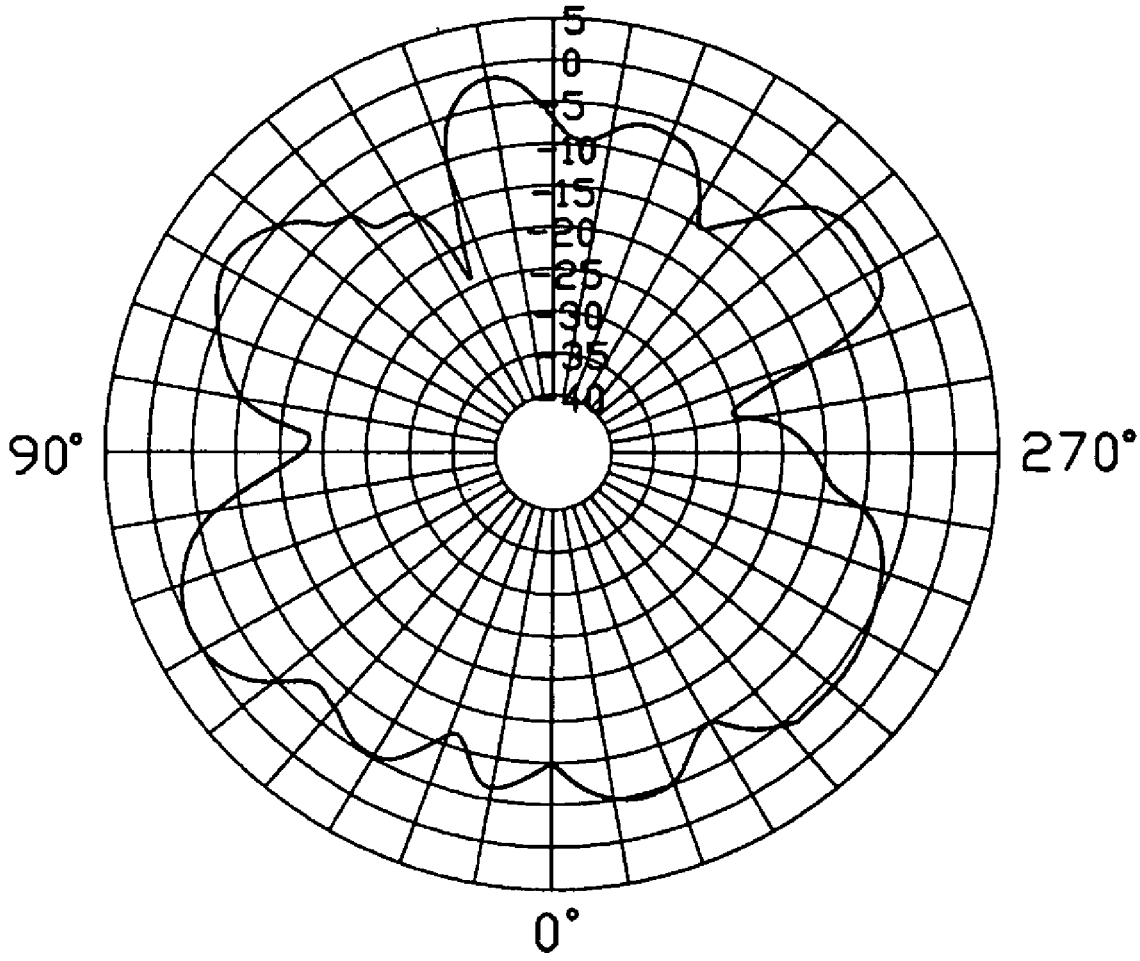
FIG. 4 is a horizontally polarized principle plane pattern of the multi-band antenna operating at the resonant frequency of 2.4375 GHz.
Figure 5:
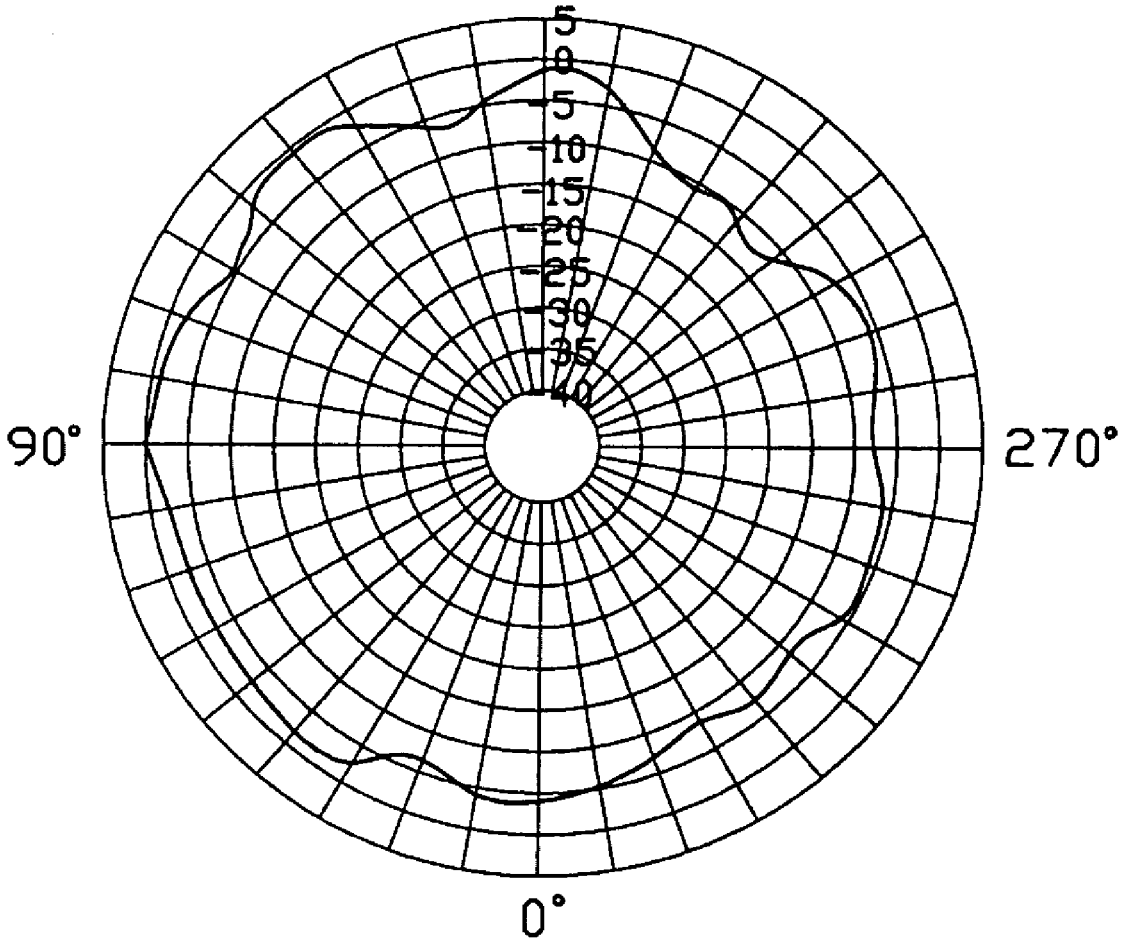
FIG. 5 is a vertically polarized principle plane pattern of the multi-band antenna operating at the resonant frequency of 2.4375 GHz.
Figure 6:
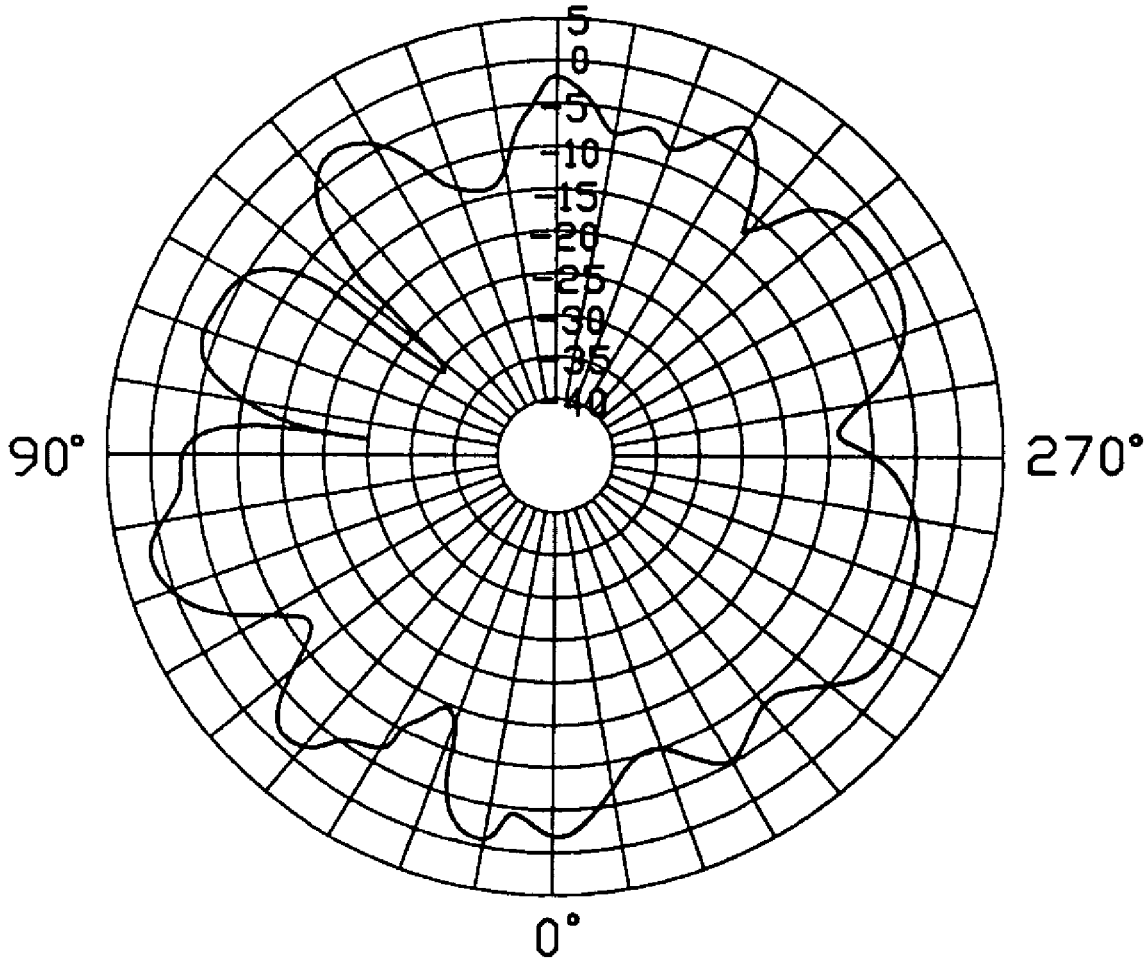
FIG. 6 is a horizontally polarized principle plane pattern of the multi-band antenna operating at the resonant frequency of 5.725 GHz.
Figure 7:
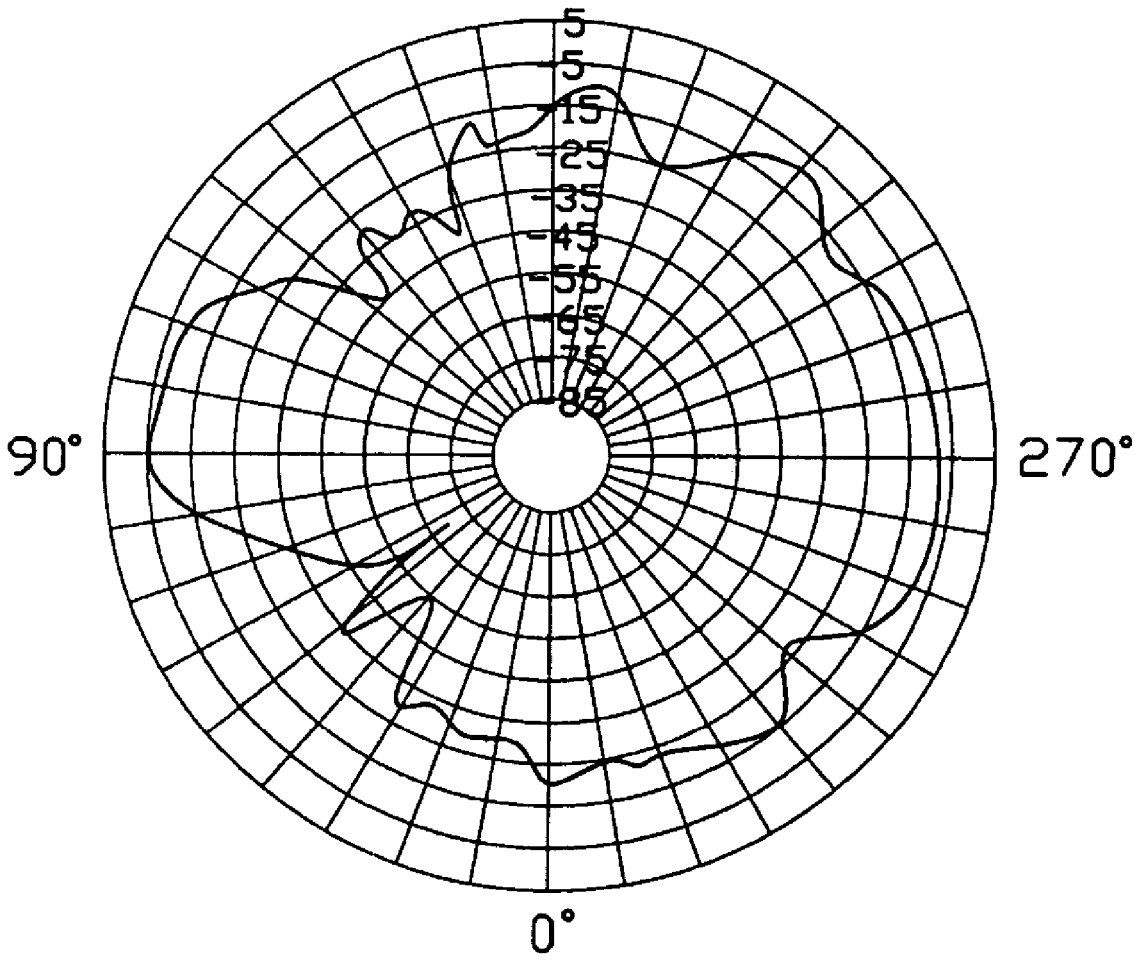
FIG. 7 is a vertically polarized principle plane pattern of the multi-band antenna operating at the resonant frequency of 5.725 GHz.

FIG. 3 a test chart recording of voltage standing wave ratio (VSWR) in accordance with the multi-band antenna 1. The VSWR of the antenna 1 is lower than 2 among the 2.3-2.5 GHz frequencies and the 5.725-5.875 GHz frequencies, so the multi-band antenna 1 satisfies current requirements.

FIGS. 4-7 are horizontally and vertically polarized principle plane pattern of the multi-band antenna 1 operating at the resonant frequency of 2.4375 GHz and 5.725 GHz. The figures show the dual WLAN antenna work reciprocally to reduce the radiating blind areas.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. A multi-band antenna, comprising:

a first antenna;

a second antenna having identical structure as that of the first antenna; and a common grounding element connecting with the first antenna and the second antenna;

each of the first and second antennas comprising a radiating element comprising a first radiating section working at a lower frequency, a second radiating section working at a higher frequency and a third radiating section forming an L shape and having a vertical arm and a horizontal arm parallel to the second radiating section, a connecting element connecting the radiating element and the grounding element, and a feeding line connecting with the radiating element, the first radiating section of the first antenna locating close to and facing to the first radiating section of the second antenna without any element there between.

2. The built-in antenna as claimed in claim 1, wherein said second antenna and said first antenna are identical located on the other side grounding portion symmetrical in structure and are oriented at opposite sides of said first grounding portion to be mirror images of each other.

3. The built-in antenna as claimed in claim 2, wherein said first radiating section comprises a first radiating arm, said second radiating section comprises a second radiating arm aligned with said first radiating arm, and said third radiating section comprisess a vertical third radiating arm extending from the joint of said first radiating arm and said second radiating arm and a perpendicular fourth radiating arm extending from said third radiating arm.

4. The built-in antenna as claimed in claim 3, wherein said third radiating arm extends along vertical direction from the joint of said first radiating arm and said second radiating arm, and said fourth radiating arm extends along parallel direction to said second radiating arm from said third radiating arm.

5. The built-in antenna as claimed in claim 3, wherein said first radiating arm is parallel to said second and fourth arms.

6. The built-in antenna as claimed in claim 1, wherein said grounding element comprises a first grounding portion and a second grounding portion located in a plane perpendicular to that of the first grounding portion.

7. The built-in antenna as claimed in claim 6, wherein said second antenna has a pair of mounting portions respectively extending therefrom, and said mounting portions are located in the same plane as that of said first grounding portion.

8. The built-in antenna as claimed in claim 6, wherein said first antenna connects to said first grounding portion.

9. The built-in antenna as claimed in claim 1, wherein said multi-band antenna is made by an entire metal patch.

10. A multi-band antenna comprising:

a first antenna;

a second antenna having a similar structure with the first antenna while in an inverse manner; and a common grounding element connecting with the first antenna and the second antenna;

each of the first and second antennas comprising a radiating element comprising a first radiating section working at a lower frequency, a second radiating section working at a higher frequency and a third radiating section, a straight connecting element connecting the radiating element and the grounding element, wherein a combination of the first radiating section and the second radiating section of the first antenna is communicatively directly facing to another combination of the first radiating section and the second radiating section of the second antenna without any portion of the common grounding element obstructing therebetween.

11. The built-in antenna as claimed in claim 10, wherein a feeding line connects with the radiating element.

12. The built-in antenna as claimed in claim 10, wherein an enlarged grounding plane is connected to the grounding element and defines securing sections extending at two opposite ends, and wherein the enlarged grounding plane is perpendicular to the grounding element while the securing sections are parallel to said grounding element.

13. The built-in antenna as claimed in claim 10, wherein a whole structure of said antenna is symmetrically arranged with regard to a center line of said antenna.

14. The built-in antenna as claimed in claim 10, wherein the first radiating section and the second radiating section are aligned with each other while the third radiating section is spaced from said aligned first and second radiating sections in a parallel manner but aligned with a horizontal segment of said connecting element.

15. The built-in antenna as claimed in claim 10, wherein the combination is side by side close to said another combination.

16. The built-in antenna as claimed in claim 10, wherein said common grounding element includes a grounding portion coplanar with said first antenna and said second antenna under a condition that the straight connecting elements of said first antenna and said second antenna respectively connected to opposite longitudinal ends of said grounding portion along a longitudinal direction of a whole structure of said built-in antenna.

17. A multi-band antenna comprising:

a first antenna;

a second antenna having a similar structure with the first antenna while in an inverse manner; and a common grounding element connecting with the first antenna and the second antenna;

each of the first and second antenna comprising a radiating element comprising a first radiating section working at a lower frequency, a second radiating section working at a higher frequency, a straight connecting element connecting the radiating element and the grounding element; wherein.

a combination of the first radiating section and the second radiating section of the first antenna is communicatively directly facing to another combination of the first radiating section and the second radiating section of the second antenna without any portion of the common grounding element obstructing therebetween, and a whole structure of said antenna is symmetrically arranged with regard to a center line of said antenna.

18. The built-in antenna as claimed in claim 17, wherein an enlarged grounding plane is connected to the grounding element and defines securing sections extending at two opposite ends, and wherein the enlarged grounding plane is perpendicular to the grounding element while the securing sections are parallel to said grounding element.

19. The built-in antenna as claimed in claim 17, wherein the combination is side by side close to said another combination.

20. The built-in antenna as claimed in claim 19, wherein said common grounding element includes a grounding portion coplanar with said first antenna and said second antenna under a condition that the straight connecting elements of said first antenna and said second antenna respectively connected to opposite longitudinal ends of said grounding portion along a longitudinal direction of a whole structure of said built-in antenna.

* * * * *